US005501024A

United States Patent [19]

Bergeron

[11] Patent Number: 5,501,024

[45] Date of Patent: Mar. 26, 1996

[54] POWER BUCKET

[76] Inventor: Raymond C. Bergeron, 3452 W. Jefferson, Trenton, Mich. 48183

[21] Appl. No.: 245,240

[22] Filed: May 17, 1994

[51] Int. Cl.[6] ..... B66C 3/02

[52] U.S. Cl. ..... 37/184; 37/466; 37/901; 294/68.23

[58] Field of Search ..... 294/68, 23; 414/624, 414/625; 37/461, 184, 185, 340, 907

[56] References Cited

U.S. PATENT DOCUMENTS

| | | | |
|---|---|---|---|
| 1,864,793 | 6/1932 | Botten | 37/184 |
| 2,744,640 | 5/1956 | Somers | 37/184 |
| 4,189,386 | 2/1980 | Aman | 37/461 |
| 4,908,966 | 3/1990 | Phillips et al. | 37/185 |
| 5,029,923 | 7/1991 | Bergeron | 37/184 |
| 5,228,735 | 7/1993 | Morrow | 294/68.23 |

FOREIGN PATENT DOCUMENTS

| | | | |
|---|---|---|---|
| 582280 | 2/1994 | European Pat. Off. | 294/68.23 |

*Primary Examiner*—Terry Lee Melius
*Assistant Examiner*—Spencer K. Warnick, IV
*Attorney, Agent, or Firm*—Gifford, Krass, Groh, Sprinkle, Patmore, Anderson & Citkowski

[57] ABSTRACT

A bucket for power shovels is disclosed having a first bucket half and a second bucket half. Each bucket half includes a pair of spaced sidewalls and an endwall extending between the sidewalls which forms a scoop. The bucket halves are pivotly secured together so that the scoops face each other and are movable between an open position, in which the scoops face downwardly, and a closed position in which the scoops face each other and form a load carrying chamber. A swiper plate is attached to one sidewall on each side of the bucket. This swiper plate overlaps a portion of the other sidewall on its associated side of the bucket as the bucket halves pivot between a partially closed and a fully closed position.

13 Claims, 3 Drawing Sheets

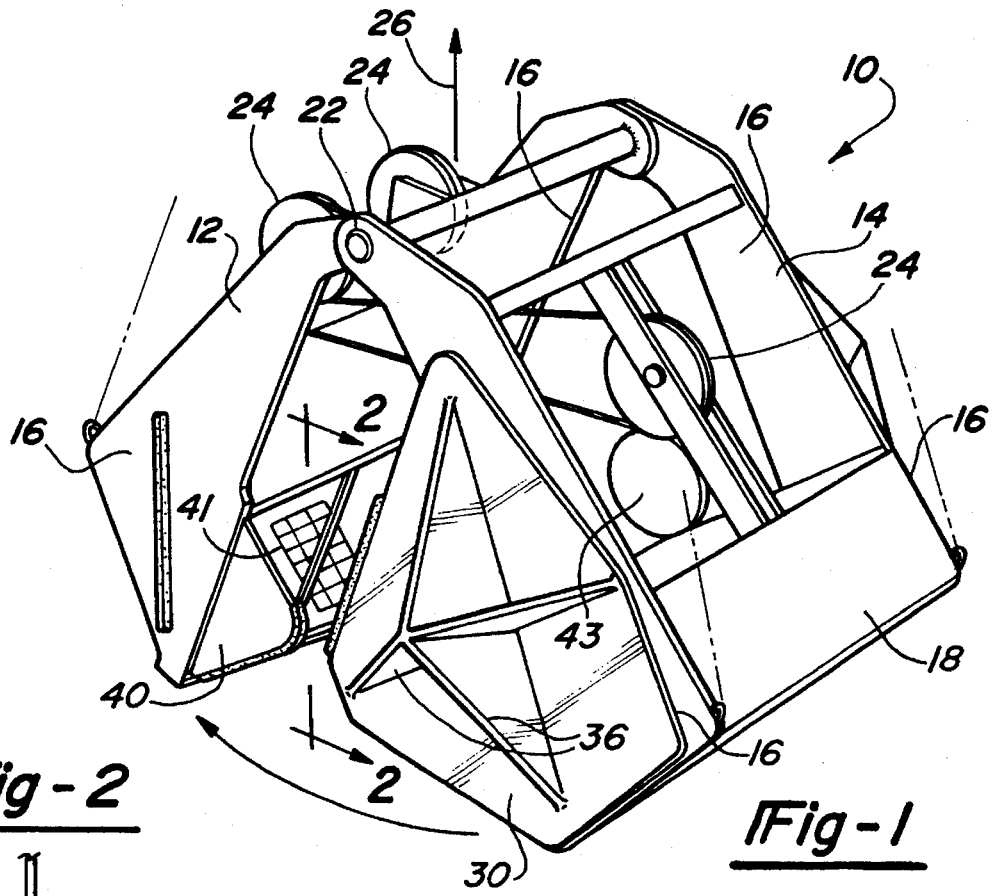
Fig-1
Fig-2
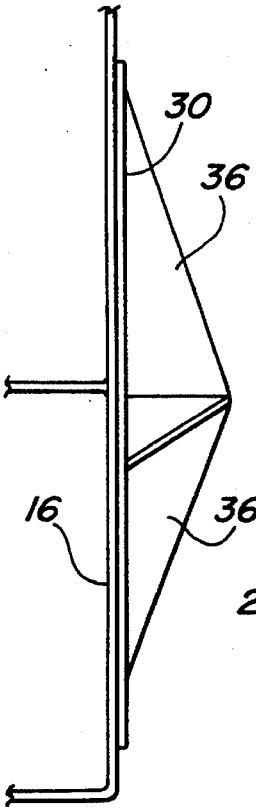
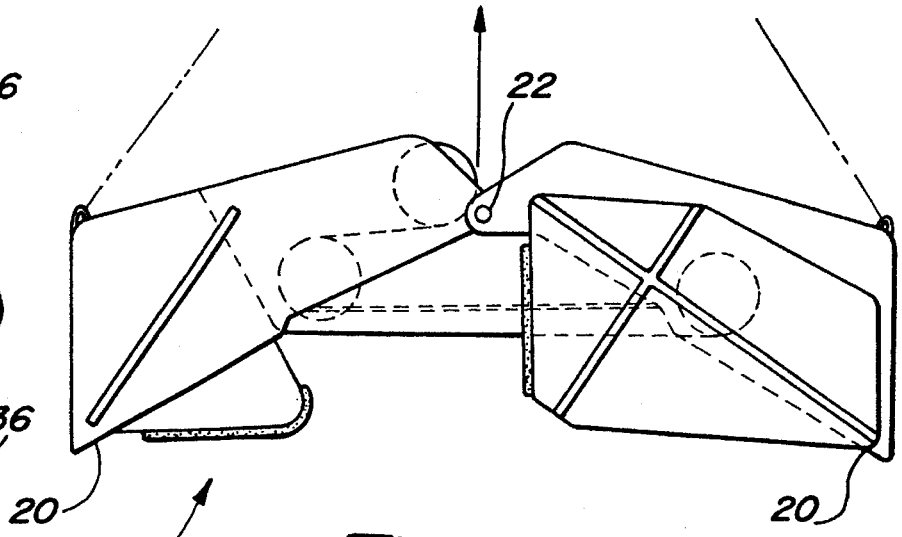
Fig-3

POWER BUCKET

BACKGROUND OF THE INVENTION

I. Field of the Invention

The present invention relates to a bucket for a power shovel.

II. Description of the Prior Art

There are many previously known buckets for power shovel of the type used for dredging, digging and the like. Many of these previously known buckets are known as "clam-shell" buckets and consist of two bucket halves which are pivotly secured to each other Each bucket half forms a scoop and, as the bucket halves pivot together, these scoops close together and form a load carrying chamber. The power shovel then moves the closed bucket with its load to the desired dumping site.

Power shovels with buckets are frequently used to remove hazardous waste and the like, especially from the bottom of waterways. In such situations, it is necessary to remove a relatively shallow volume of dirt from the bottom of the waterway since hazardous spills typically remain near the top of the soil.

There have been previously known buckets for power shovels, such as the buckets disclosed in my prior U.S. Pat. No. 5,029,923, which are especially designed to remove a relatively shallow amount of earth during a digging operation. One problem, however with these previously known buckets is that, as the buckets are moved from their open to their closed position, an amount of soil escapes from the side of the bucket. The amount of earth which escapes in this fashion is typically contaminated with the hazardous waste since it represents only the upper portion of the removed earth. Additional dredging to completely remove the hazardous waste is, therefor, required. This increases the overall cost and time required to remove the hazardous waste from the excavation site.

SUMMARY OF THE PRESENT INVENTION

The present invention provides a bucket for a power shovel which overcomes all of the above-mentioned disadvantages of the previously known buckets.

In brief, the bucket of the present invention comprises a first bucket half and a second bucket half. Each bucket half has a pair of spaced sidewalls and an endwall extending between the sidewalls which form a scoop on each bucket half.

The bucket halves are pivotly secured together so that the scoops face each other. Furthermore, the bucket halves are moveable between an open position, in which the scoops face generally downwardly, and a closed position in which these scoops face each other and form a load carrying chamber.

In order to minimize the spillage of soil from the side of the bucket as the bucket halves are moved to their closed position a swiper plate is attached to one sidewall on each side of the bucket half. The swiper plate overlaps a portion of the other sidewall against the associated side of the bucket as the bucket halves pivot between a partially closed and a fully closed position. Consequently, the swiper plate effectively closes the sides of the bucket between the partially closed and fully closed position thereby minimizing the spillage of soil out through the sides of a bucket as it is closed.

BRIEF DESCRIPTION OF THE DRAWING

A better understanding of the present invention will be had upon the reference to the following detailed description when read in conjunction with the accompanying drawing, wherein like reference characters refer to like parts throughout the several views, and in which:

FIG. 1 is an elevational view illustrating a preferred embodiment of the present invention;

FIG. 2 is a view taken substantially taken along line 2—2 in FIG. 1;

FIG. 3 is a side view of the preferred embodiment of the present invention and illustrating the bucket in an open position;

DETAILED DESCRIPTION OF A PREFERRED EMBODIMENT OF THE PRESENT INVENTION

Figure 4:
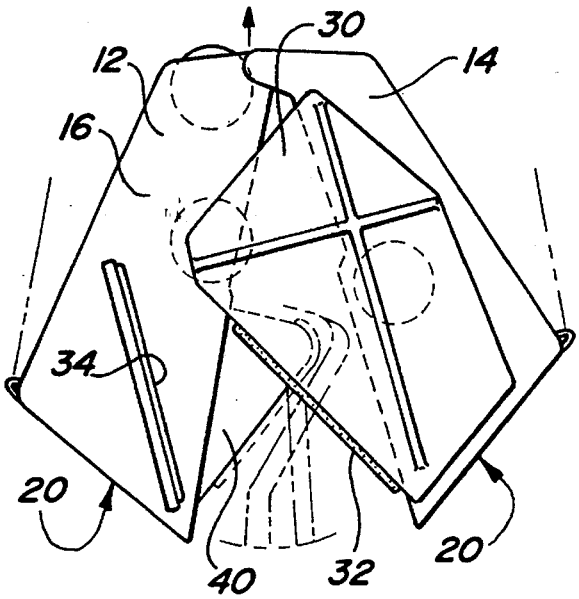
FIG. 4 is a view similar to FIG. 3 but illustrating the bucket in a partially closed position.

With reference first to FIGS. 1–3, a first preferred embodiment of the bucket 10 of the present invention is thereshown and comprises a pair of bucket halves 12 and 14. Each bucket half 12 and 14 includes a pair of spaced and generally parallel sidewalls 16 and an endwall 18 which extends between the sidewalls 16 and, together with the sidewalls 16 forms a scoop 20.

Figure 5:
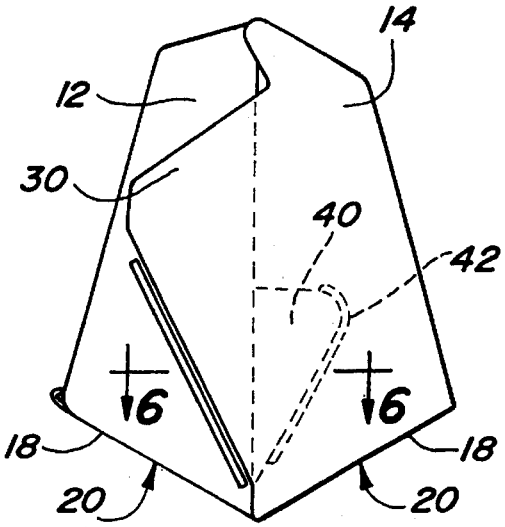
FIG. 5 is a view similar to FIGS. 3 and 4 but illustrating the bucket in a fully closed position.
Figure 7:
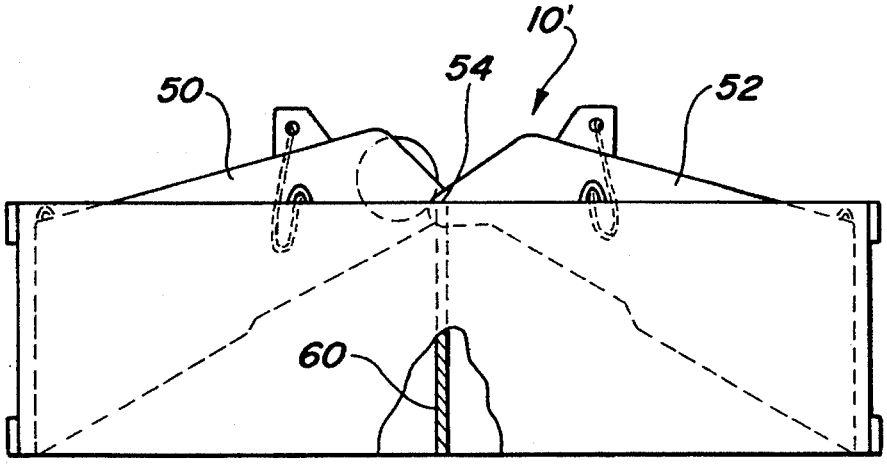
FIG. 7 is a side view illustrating a second preferred embodiment of the present invention and illustrating the bucket in an open position.

A pivot shaft 22 pivotly secures the bucket halves 12 and 14 together so that the bucket halves are pivotal between an open position, illustrated in FIG. 3, and a closed position, illustrated in FIG. 5. In their open position, the open sides of the scoops 20 face generally downwardly and toward the ground to be excavated Conversely in their closed position the open ends of the scoops 20 face and are closely adjacent each other thus forming an interior load carrying chamber of the bucket 10.

Any conventional means such as pulleys 24 (FIG. 1) and a lift line 26 can be used to not only move the buckets from their open to their closed position, but also lift the bucket with its contained load to the appropriate dump site. Since the closing and lift mechanism 24, 26 is conventional in construction, a further description thereof is unnecessary.

With reference again to FIGS. 1–3, a swiper plate 30 is secured to one sidewall 16 on each side of the bucket 10. As shown in FIG. 1, in the preferred embodiment, each swiper plate 30 is attached to the sidewall 16 of the bucket half 14. Alternatively, however, one swiper plate 30 can be attached to one sidewall 16 of the bucket half 14 while the other swiper plate on the opposite side of the bucket is attached to the sidewall 16 of the opposite bucket half 12.

Each swiper plate 30 is spaced laterally outwardly from the sidewall 16 so that, as the bucket halves 12 and 14 are moved from a partially closed position (FIG. 4) to a fully closed position (FIG. 5) the swiper plate 30 overlaps at least a portion of the other sidewall 16 on its associated side of the bucket. Consequently, the swiper plate 30 effectively covers the opening between the sides of the bucket halves 12 and 14 and prevents the escape of the load from the sides of the bucket 10 as the bucket 10 is closed.

Figure 6:
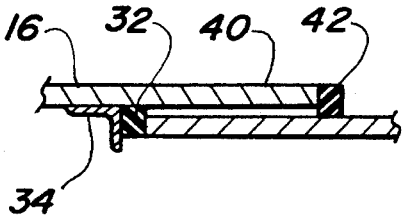
FIG. 6 is a fragmentary sectional view taken substantially along line 6—6 in FIG.5.

As best shown in FIGS. 4 and 6, a sealing strip 32 is preferably provided along a free edge of the swiper plate 30. This sealing strip sealingly engages a sealing flange 34 on the other bucket half 12 in order to fluidly seal the swiper plate 32 to the other bucket half 12.

With reference again to FIGS. 1 and 2, reinforcing ribs 36 are preferably provided on the outside surface of the swiper plate 30. These reinforcing ribs 36 prevent flexing and bending of the swiper plate 30.

With reference now to FIGS. 1, 3 and 5, a second swiper plate 40 is preferably secured to the other sidewall 16 opposite from the sidewall 16 to which the first swiper plate 30 is attached. The second swiper plate 40 stays laterally inwardly from its attached sidewall 16 on the bucket half 12.

As best shown in FIGS. 4 and 5, the second swiper plate 40 is dimensioned so that, as the bucket halves 12 and 14 are moved between a partially closed position (FIG. 4) to a fully closed position (FIG. 5) the second swiper plate 40 partially overlaps the swiper plate 30 and/or the sidewall 16 to which the first swiper plate 30 is attached.

Since the second swiper plate 40 is positioned laterally inwardly from its attached sidewall 16 on the bucket half 12, the second swiper plate 40 is received within the inside of the sidewall 16 for the bucket half 14 when the bucket halves 12 and 14 are moved to their fully closed position (FIG. 5). A seal strip 42 (FIGS. 5 and 6) fluidly seals the second swiper plate 40 to the bucket half 14.

The swiper plates 40 and 30 together cooperate to minimize the escape of the load from the side of the bucket as the bucket is moved from its open to its closed position.

With reference particularly to FIG. 1, in the preferred embodiment, a portion of at least one endwall comprises a screen 41. Thus, when the bucket halves 12 and 14 are closed, the screen 41 enables water or other liquid to escape or drain from the load carried by the bucket. A pressurizing means 43 (illustrated only diagrammatically), such as an air bag or actuated pressure plate, can also be used to pressurize the load when the bucket is closed to further enhance draining water or other liquid from the load.

Figure 8:
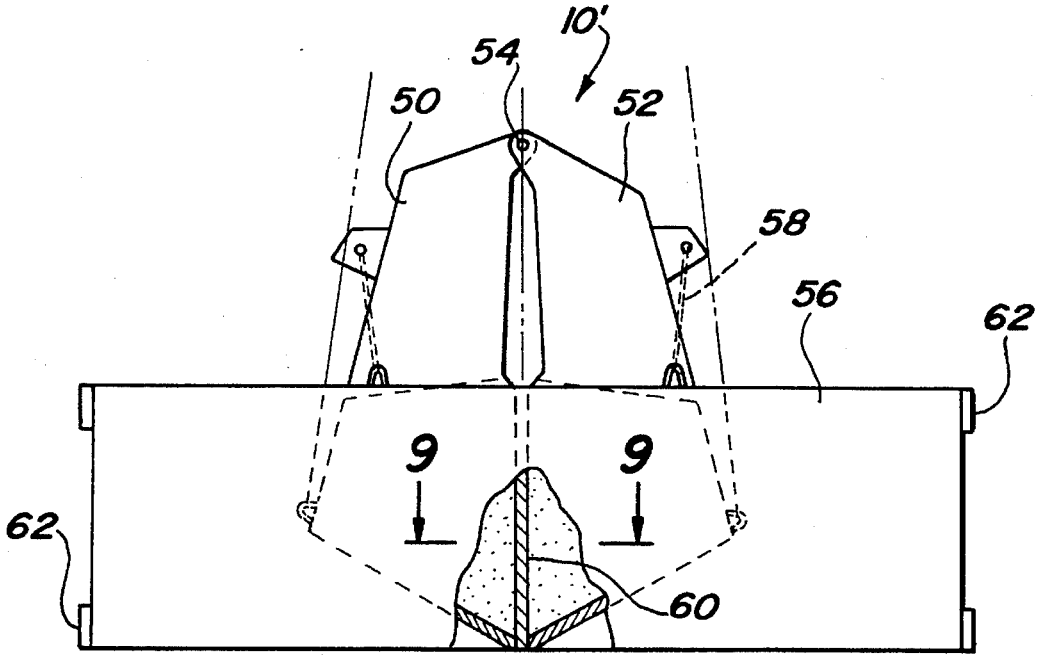
FIG. 8 is a side view of the second preferred embodiment of the present invention but illustrating the bucket in a fully closed position.
Figure 9:
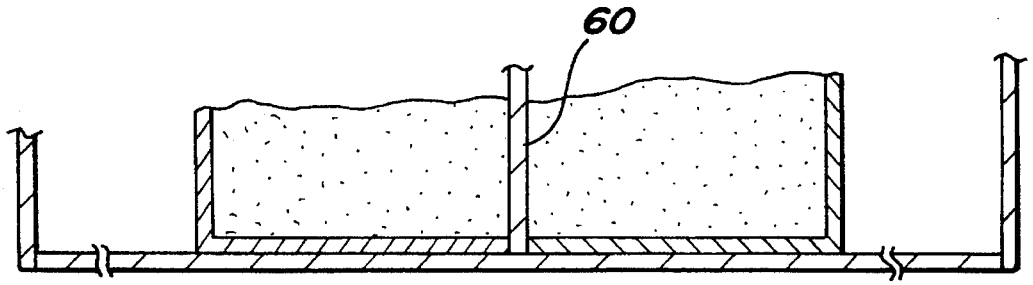
FIG. 9 is a fragmentary sectional view taken substantially along line 8—8 in FIG.8.
Figure 10:
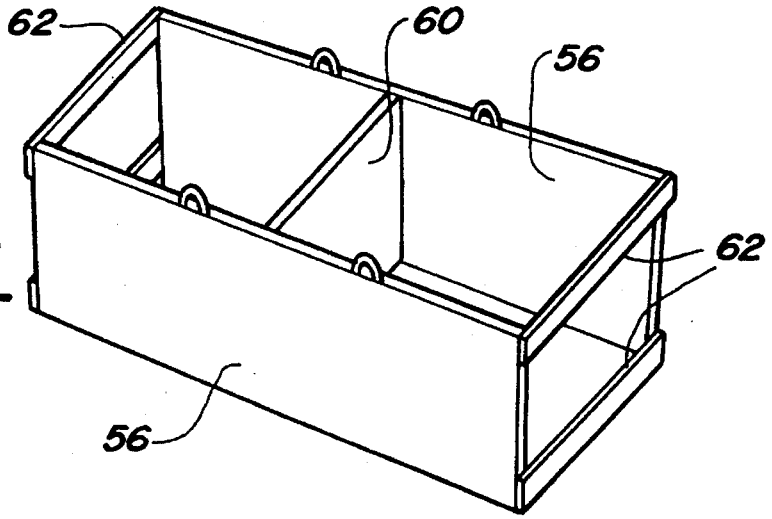
FIG. 10 is an elevational view illustrating a portion of the second preferred embodiment of the present invention.

With reference now to FIGS. 7–10 a second preferred embodiment of the bucket 10 of the present invention is thereshown. As before, the bucket 10 has a first bucket half 50 and a second bucket half 52 each of which forms the scoop. The bucket halves 50 and 52 are pivotly secured together by a pivot shaft 54 and are moveable between an open position (FIG. 7) and a closed position (FIG. 8).

Unlike the first preferred embodiment of the present invention the power bucket 10 does not include the swiper plates 30 or 40 (FIG. 4). Instead a pair of spaced and parallel flat plates 56 are provided and these flat plates 56 are suspended from the bucket 10 by chains 58. Furthermore, one flat plate 56 is positioned along one side of the bucket 10 while, conversely, the other plate 56 is positioned along the other side of the bucket 10.

In order to maintain the plates 56 closely adjacent to the sides of the bucket 10, at least one cross plate 60 extends between the plates 56 and preferably the cross plate 60 is positioned in between the bucket halves 50 and 52. Additional cross members 62 also extend between the plates 56 across their ends in order to further rigidify the plates 56.

The plates 56 together with the cross plate 60 are dimensioned to maintain the plates 56 closely adjacent the sides of the bucket 10 as the bucket is moved from its open to its closed position. Consequently the plates 56 effectively close the side openings between the bucket halves 50 and 52 and prevent the escape or overflow of the load from the sides of the bucket 10 as it is moved to its closed position. In effect the plates 56 perform a function similar to the swiper plates 30 and 40 of the first preferred embodiment (FIGS. 1–5).

From the foregoing, it can be seen that the present invention provides a bucket for a power shovel which minimizes the escape of the load from the sides of the bucket as the bucket is moved from its open to its closed position. Having described my invention, however, many modifications thereto will become apparent to those skilled in the art to which it pertains without deviation from the spirit of the invention as defined by the scope of the appended claims.

I claim:

1. A bucket for a power shovel comprising:

a first bucket half and second bucket half, each bucket half having a pair of spaced sidewalls and an endwall extending between said sidewalls which form a scoop, means for pivotally securing said bucket halves together so that said scoops face each other, said bucket halves being moveable between an open position in which said scoops face each other and form a load carrying chamber, a first swiper plate attached to one sidewall on each side of the bucket, a second swiper plate attached to the other sidewall on each side of the bucket, said first swiper plates being generally V-shaped and having an apex which extends toward said other sidewall, said second swiper plates being generally V-shaped and having an apex which extends toward said one sidewall, each said second swiper plate overlapping a portion of said first swiper plate and the other sidewall on its associated side of the bucket as said bucket halves pivot between a partially closed and a fully closed position.

2. The invention as defined in claim 1 and comprising means for fluidly sealing said swiper plate to said other sidewall on its associated side of the bucket.

3. The invention as defined in claim 2 wherein said sealing means comprises a resilient strip secured to said swiper plate.

4. The invention as defined in claim 1 wherein said swiper plate is spaced laterally outwardly from its attached sidewall.

5. The invention as defined in claim 1 wherein said sealing means comprises a resilient strip secured to said second swiper plate.

6. The invention as defined in claim 1 wherein said second swiper plate is spaced laterally inwardly from its attached sidewall.

7. The invention as defined in claim 1 wherein a portion of at least one endwall comprises a screen.

8. The invention as defined in claim 7 and comprising means for pressurizing a load in the bucket.

9. A bucket for a power shovel comprising:

a first bucket half and a second bucket half, each bucket half having a pair of spaced sidewalls and an endwall extending between said sidewalls which form a scoop, means for pivotally securing said bucket halves together so that said scoops face each other, said bucket halves being moveable between an open position in which said scoops face downwardly and a closed position in which said scoops face each other and form a load carrying chamber, a pair of flat plates, flexible members for securing said plates to said bucket halves so that one plate overlaps the sidewalls on one side of the bucket while the other plate overlaps the sidewalls on the other side of the bucket and so that said bucket halves are movable relative to said plates.

10. The invention as defined in claim 9 and comprising at least one cross plate extending between said flat plates.

11. The invention as defined in claim 10 wherein said cross plate extends between said bucket halves.

12. The invention as defined in claim 9 wherein a portion of at least one endwall comprises a screen.

13. The invention as defined in claim 12 and comprising means for pressurizing a load in the bucket.

* * * * *